US008448701B1

(12) United States Patent
McClinton et al.

(10) Patent No.: US 8,448,701 B1
(45) Date of Patent: May 28, 2013

(54) WELLHEAD PROTECTION TOOL

(75) Inventors: Tony D. McClinton, Odessa, TX (US); Buster Carl McClinton, Odessa, TX (US)

(73) Assignee: Tony D. McClinton, Odessa, TX (US)

( * ) Notice: Subject to any disclaimer, the term of this patent is extended or adjusted under 35 U.S.C. 154(b) by 0 days.

(21) Appl. No.: 13/428,301

(22) Filed: Mar. 23, 2012

(51) Int. Cl.
*E21B 33/03* (2006.01)

(52) U.S. Cl.
USPC ..... 166/86.1; 166/250.1; 166/308.1; 166/305.1

(58) Field of Classification Search
USPC ..... 166/250.01, 308.01, 177.5, 84.1, 166/85.1, 86.1, 250.1
See application file for complete search history.

(56) References Cited

U.S. PATENT DOCUMENTS 5,769,161 A * 6/1998 Borden ..... 166/72
6,220,349 B1 4/2001 Vargus et al.
6,231,265 B1 * 5/2001 Rytlewski et al. ..... 403/322.1
6,491,108 B1 12/2002 Slup et al.
6,581,681 B1 6/2003 Zimmerman et al.
6,796,376 B2 9/2004 Frazier
7,520,322 B2 * 4/2009 Duhn et al. ..... 166/75.13
7,614,448 B2 11/2009 Swagerty et al.
7,644,757 B2 * 1/2010 Artherholt ..... 166/113
2010/0230114 A1 * 9/2010 Jennings ..... 166/377
2010/0280770 A1 * 11/2010 Levy ..... 702/51

* cited by examiner

*Primary Examiner* — William P Neuder
*Assistant Examiner* — Richard Alker
(74) *Attorney, Agent, or Firm* — Buskop Law Group, PC; Wendy Buskop

(57) ABSTRACT

A wellhead protection tool for simultaneously fitting within a lower portion of a tubing head and extending into a gate valve can have four portions with different diameters. A plurality of sealing grooves with seals can provide for sealing of the wellhead protection tool. A locking ring can engage the tubing head and injection portions thereof, allowing for continuous monitoring of seals between the tubing head and the gate valve using a client device at a remote location.

18 Claims, 6 Drawing Sheets

WELLHEAD PROTECTION TOOL

FIELD

The present embodiments generally relate to a wellhead protection tool for isolating a portion of a wellhead during a drilling or work over operation.

BACKGROUND

While pumping muds down an oilfield well particulate can come back up the oilfield well and damage equipment. Damaged equipment can explode, causing toxic spills to the environment. Damaged equipment can also kill or maim workers at the oilfield well site.

An oilfield well can have a casing head supporting an outer casing string. A casing hanger can be positioned in the casing head to support an inner string or production casing string. A tubing head is typically positioned above the casing head.

During normal production operations, the tubing head can support a tubing hanger and production tubing. The production casing string can extend downwards into a hydrocarbon bearing formation.

It is common to fracture a new well to increase the production capability of the new well. Generally, in this process, a sand bearing slurry is pumped down into a formation at very high pressures. Sand particles can become embedded in small cracks in the formation and can wedge the small cracks open; thereby increasing the flow of produced fluid, such as oil, natural gas, or water.

The tubing head with associated valves can control the flow of the pressurized fluid coming from the fractionation of the new well. The tubing head can be damaged by particles in the pressurized fluid, such as the sand particles.

A need exists for a wellhead protection tool to protect portions of the tubing head and gate valves for the safety of the workers, and to prevent spills in the occurrence of explosions.

A need exists for a removable wellhead protection tool that does not require pulling of an entire production string with bridge plugs and ball drop plugs.

A need exists for a wellhead protection tool that saves significant costs and time in the management of wells.

A need exists for a simple wellhead protection tool that is easily replaced without requiring major portions of production strings to be pulled from the well, such as when the wellhead protection tool exhibits signs of failure.

The present embodiments meet these needs.

BRIEF DESCRIPTION OF THE DRAWINGS

The detailed description will be better understood in conjunction with the accompanying drawings as follows.

Figure 1:
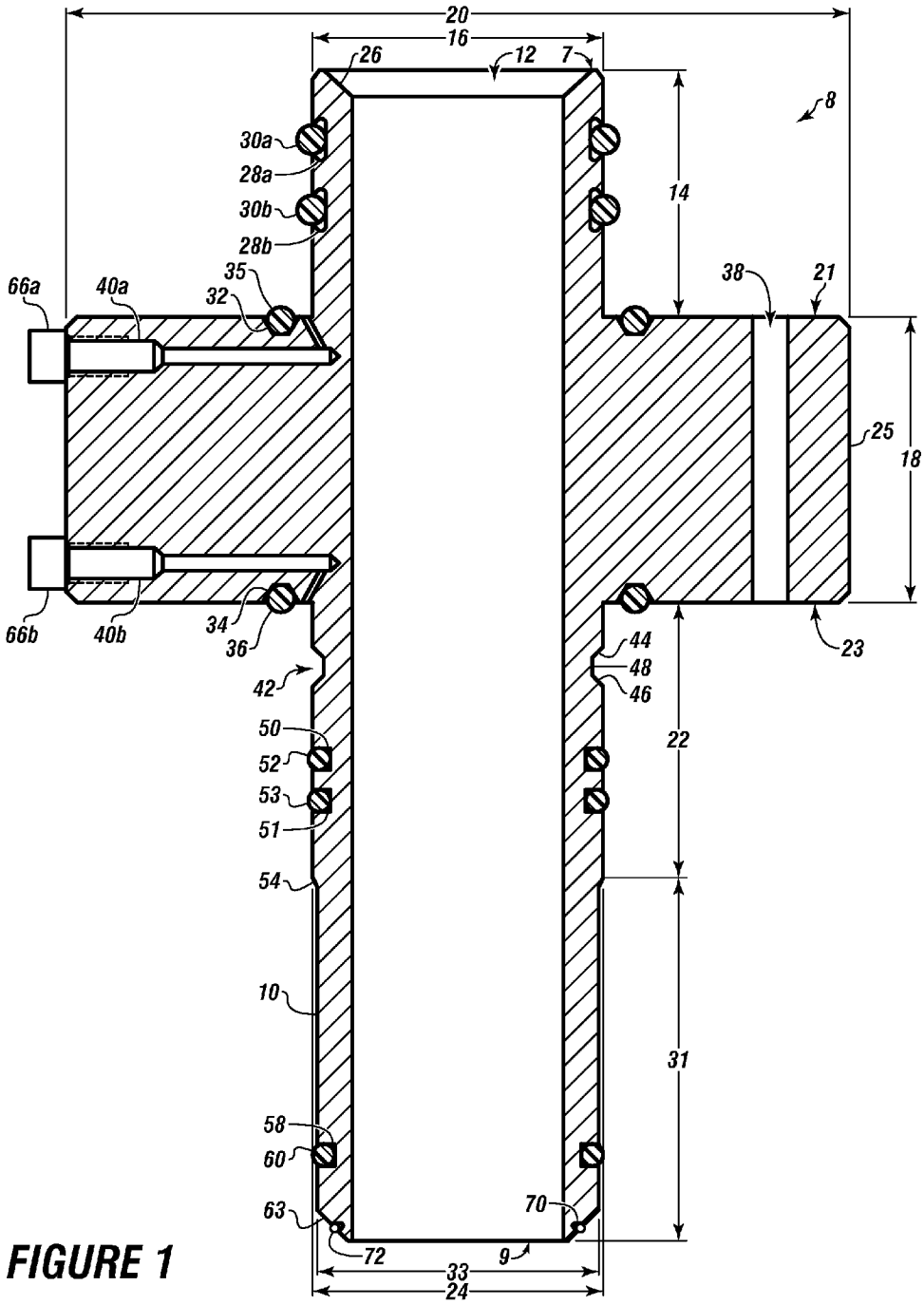
FIG. 1 depicts a cross sectional view of a first embodiment of the wellhead protection tool.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to wellhead protection tool that can protect gate valves and tubing heads in wells.

The wellhead protection tool can be modular and easily replaceable.

In embodiments, the wellhead protection tool can include a one-piece central tubular having a length that ranges from between about 2 feet to about 6 feet and a wall thickness that ranges from between about 1 inch to about 3 inches.

The one-piece central tubular can be made of carbon steel alloy, stainless steel, or combinations thereof.

The one-piece central tubular can have a first portion, a second portion, a third portion, and a fourth portion. The second portion can have a diameter ranging from between about 10 inches to about 30 inches.

The wellhead protection tool can include a plurality of seals, which can be compressible nitrile rubber seals or a polyamide seals.

Embodiments of the well head protection tool can have coatings disposed thereon, such as a ceramic coating. The coatings can be disposed on all outer portions of the one-piece central tubular to inhibit deterioration from particulates and rusting. The coating can be a non-stick coating, such as TEFLON®, enabling fast engagement and release of the well head protection tool. The coating can have a thickness ranging from between about 1/64 of an inch to about 1/32 of an inch.

To install the wellhead protection tool, the wellhead protection tool can be prepared for operation by placing a seal in each seal grooves thereon. The seals can be greased, such as with a lithium grease or another grease.

A ring gasket can be placed in each ring groove.

Next, the prepared wellhead protection tool can be lowered until two simultaneous engagements are made, including engagement of a landing shoulder with an inner diameter of the tubing head and engagement of a second ring groove with a second ring gasket.

A first ring gasket can be inserted in a first ring groove.

A gate valve can be positioned over the first portion to rest on the first ring gasket of a first face of the wellhead protection tool.

Lock screws in the tubing head can be tightened to engage locking groove.

Bolts can be inserted into each fastener hole of the wellhead protection tool.

Nuts can be threaded onto each bolt using sufficient torque to compress and energize each seal formed via the ring gaskets.

Once the wellhead protection tool is installed, a test pump can be connected to each of the injection ports, and a predetermined amount of test pressure can be applied to a second seal for a predetermined length of time.

The test pressure can be from between about 5 psi to about 15,000 psi, and can be applied for a duration ranging from between about 30 minutes to about 60 minutes.

A pressure gauge can be attached to the test pump to show a variable pressure if a leak is present. The pressure gauge can maintain pressure and present a constant pressure if no leak is present; thereby ensuring a positive seal.

After pressure testing, a relief valve on the test pump can be opened to relieve stored pressure from testing areas.

A pressure detector can be inserted into each injection port to allow for continuous monitoring of pressure for early detection of seal failures.

Turning now to the Figures, FIG. 1 depicts a cross sectional view of a first embodiment of the wellhead protection tool.

The wellhead protection tool 8 can be inserted into the inner bore of the tubing head and fit within a lower portion thereof. Locking pins on the tubing head can engage with a locking groove on a one-piece central tubular 10 of the wellhead protection tool 8. While fitting within the tubing head, the wellhead protection tool 8 can simultaneously extend into a gate valve; thereby providing redundant isolation and segmented pressurized wellhead protection from particulates.

The one-piece central tubular 10 can have a first portion 14, a second portion 18 integral with the first portion 14, a third portion 22 integral with the second portion 18, and a fourth portion 31 integral with the third portion 22.

The one-piece central tubular 10 can be coated on all outer portions with a coating, which can be a ceramic coating or a non-stick coating.

The one-piece central tubular 10 can have a constant diameter central bore 12 extending through all four portions thereof from a first end 7 to a second end 9 of the one-piece central tubular 10.

The first portion 14 can have a first outer diameter 16.

The first portion 14 can have a first sloping guide 26 formed on the first portion 14. The first sloping guide 26 can slope from the first outer diameter 16 to the constant diameter central bore 12 at the first end 7.

A first seal groove 28*a* can be formed in the first outer diameter 16 between the first sloping guide 26 and the second portion 18. The first seal groove 28*a* can be deep enough to support a first seal, such as an O-ring. The O-ring can be made of rubber nitrile or another material that is durable, able to sustain high pressures over 15,000 psi, and non-deformable in extreme cold, such as −32 degrees Celsius.

A first seal 30*a* can be disposed within the first seal groove 28*a* for sealing against an inner diameter of the gate valve.

The second portion 18 can have a second outer diameter 20. The second outer diameter 20 can be larger than the first outer diameter 16. The second outer diameter 20 can be large enough to prevent the one-piece central tubular 10 from slipping into wellbores.

In one or more embodiments, the second portion 18 can have a circumference that is greater than the circumference of the first portion 14 and the third portion 22. The second portion 18 can be hollow.

The second portion 18 can have a first face 21, a second face 23, and a side surface 25 between the first face 21 and the second face 23.

A plurality of fastener holes 38 can be formed between the first face 21 and the second face 23, and can be spaced equidistantly around the constant diameter central bore 12.

A first ring groove 32 can be formed on the first face 21, and can contain a first ring gasket 35.

A second ring groove 34 can be formed on the second face 23, and can contain a second ring gasket 36.

The first ring gasket 35 and the second ring gasket 36 can seal the one-piece central tubular 10 against two different members of the well. For example, the first ring gasket 35 can seal the one-piece central tubular 10 against the gate valve, and the second ring gasket 36 can seal the one-piece central tubular 10 against the tubing head; thereby providing two different pressure zones for safety and monitoring.

The second portion 18 can have a first injection port 40*a* formed in the side surface 25 and adapted for applying pressure to the first face 21 to test for seal integrity of the first ring gasket 35.

A second injection port 40*b* can be formed in the side surface 25 parallel with the first injection port 40*a*. The second injection port 40*b* can be adapted to apply pressure to the second face 23 to test for seal integrity of the second ring gasket 36.

Pressure detectors 66*a* and 66*b* can be inserted in the first injection port 40*a* and the second injection port 40*b*, allowing for simultaneous testing and monitoring by the pressure detectors 66*a*-66*b*.

The third portion 22 can have a third outer diameter 24, which can be smaller than the second outer diameter 20 and equivalent or substantially equivalent to the first outer diameter 16.

A locking groove 42 can be formed on the third outer diameter 24 around the perimeter of the constant diameter central bore 12 for receiving locking pins of the tubing head.

The locking groove 42 can have three segments, including a first sloping side 44 and a second sloping side 46 opposite the first sloping side 44, both of which can taper towards a center 48 of the locking groove 42.

In embodiment, the locking groove 42 can be colored with a pigment to allow for easy visual recognition of a size of the wellhead protection tool 8 in the field.

The third portion 22 can have a third seal groove 50 disposed on the third outer diameter 24. The locking groove 42 can be disposed between the third seal groove 50 and the second portion 18.

A third seal 52 can be disposed in the third seal groove 50 for sealing the one-piece central tubular 10 against an inner diameter of the tubing head.

A landing shoulder 54 can be formed on the outer diameter of the third portion 22, and can taper towards the second end 9. The landing shoulder 54 can have a slope that is from between about 40 degrees to about 50 degrees for preventing the wellhead protection tool 8 from slipping into the wellbore.

The fourth portion 31 can have a fourth outer diameter 33, which can be at least about 2 percent smaller than the second outer diameter 20.

The fourth portion 31 can have a second guide 63 disposed on the second end 9. The second guide 63 can taper from the fourth outer diameter 33 towards the constant diameter central bore 12. The slope of the second guide 63 can be about 45 degrees.

A fifth seal groove 58 can be formed on the fourth outer diameter 33 between the landing shoulder 54 and the second guide 63.

A fifth seal 60 can be disposed in the fifth seal groove 58 for sealing the one-piece central tubular 10 against the inner diameter of the tubing head.

In one or more embodiments, the wellhead protection tool 8 can have a second seal groove 28*b* with a second seal 30*b*. Also, the wellhead protection tool 8 can have a fourth seal groove 51 disposed on the third outer diameter 24 with the locking groove 42 disposed between the fourth seal groove 51 and the second portion 18. A fourth seal 53 can be disposed in the fourth seal groove 51 for sealing the one-piece central tubular 10 against the inner diameter of the tubing head.

In one or more embodiments, the wellhead protection tool 8 can have a trash groove 70 formed in the second end 9 for supporting a non-pressurized seal 72 to prevent particulates and other trash from moving up an outer side of the one piece central tubular 10.

Figure 2:
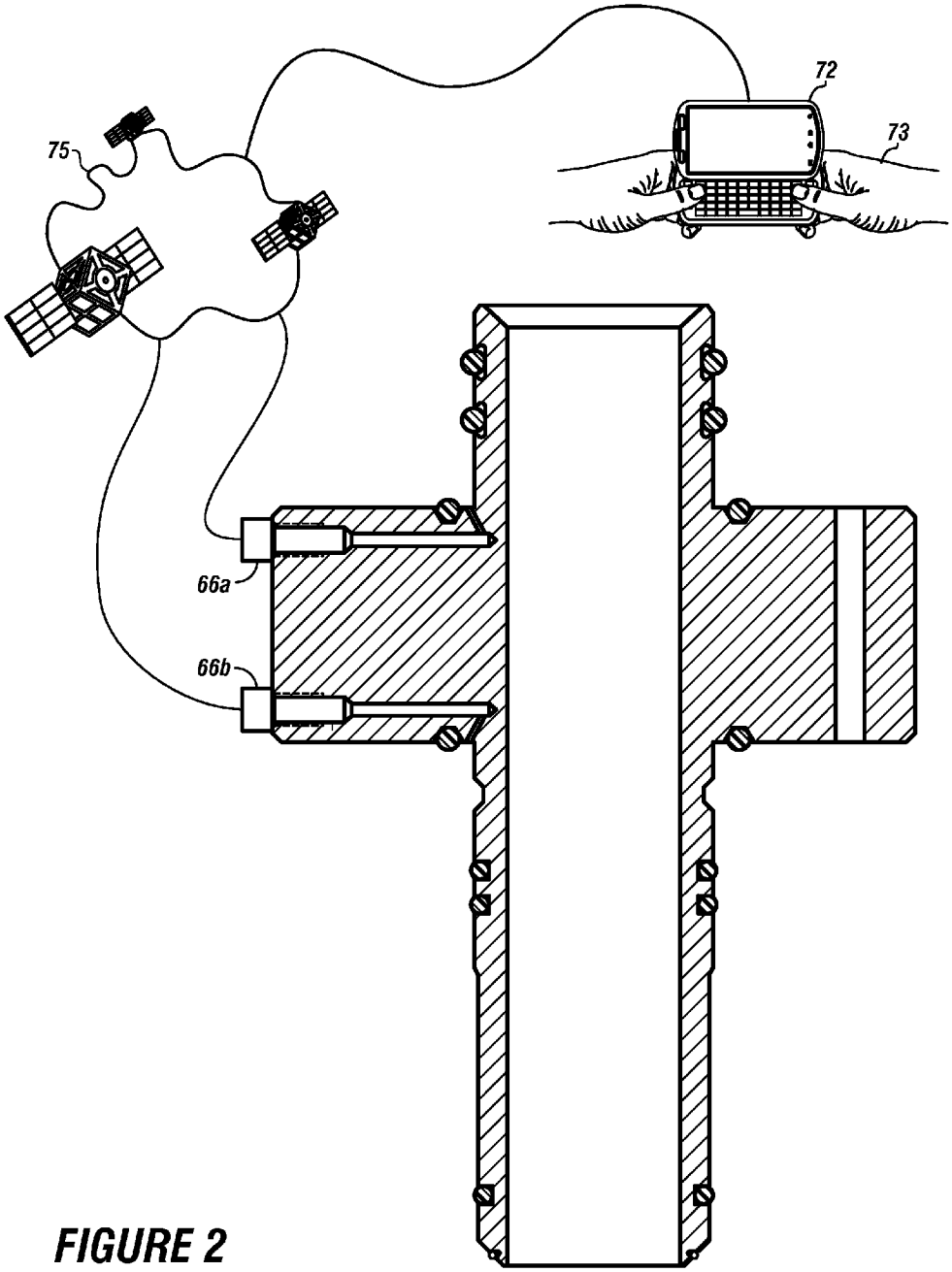
FIG. 2 depicts a network configured to provide communication between the pressure detectors and one or more client devices.

FIG. 2 depicts a network 75 configured to provide communication between the pressure detectors 66*a* and 66*b* and one or more client devices 72.

The pressure detectors 66*a* and 66*b* can be in communication with a client device 72 via a network 75; thereby allowing a user 73 remote to the pressure detectors 66*a* and 66*b* to monitor the pressures continuously from a safe distance.

In embodiments, the pressure detectors 66*a* and 66*b* can be operated independently from each other.

The network 75 can be the Internet, a local area network, a wide area network, a satellite network, a cellular network, or combinations thereof. The client device 72 can receive signals from the pressure detectors over the network 75.

Figure 3:
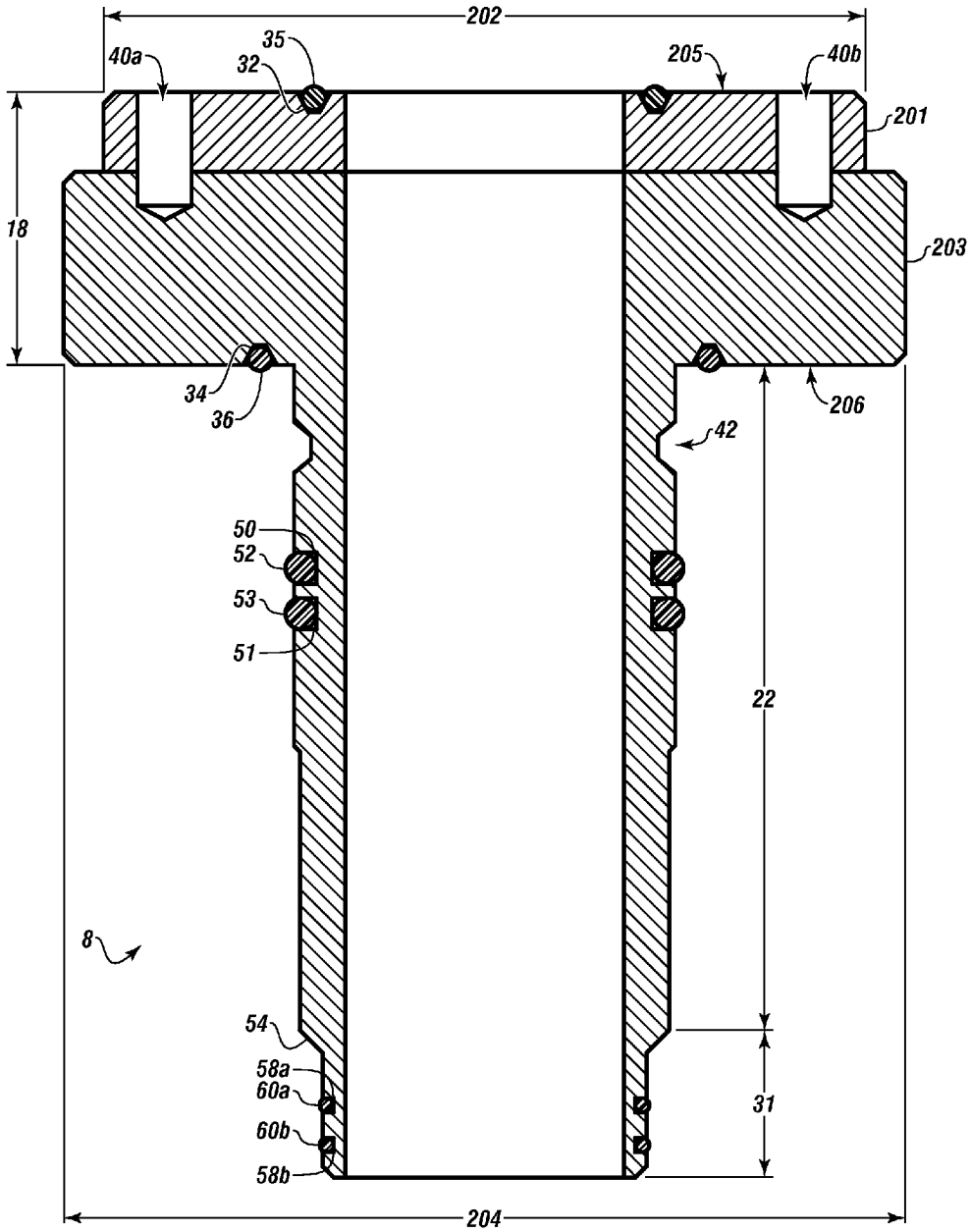
FIG. 3 depicts a partial cross sectional view of a second embodiment of the wellhead protection tool.

FIG. 3 depicts a partial cross sectional view of a second embodiment of the wellhead protection tool 8.

The second portion 18 can include a first segment 201 and a second segment 203.

The first segment 201 can have a first segment outer diameter 202 that is smaller than a second segment outer diameter 204 of the second segment 203. For example, the second segment outer diameter 204 can be about 2 percent larger in diameter than the first segment outer diameter 202.

The first segment 201 can have the first ring groove 32 with the first ring gasket 35, and the first injection port 40*a* and the second injection port 40*b* can extend from a top face 205 of the first segment 201 into the second segment 203.

The second ring groove 34 with the second ring gasket 36 can be in the second segment 203 on a bottom face 206, which can be opposite the top face 205.

The third portion 22 can have the locking groove 42, third seal groove 50, and fourth seal grove 51. The third seal groove 50 can contain the third seal 52, and the fourth seal groove 51 can contain the fourth seal 53.

The fourth portion 31 can have two fifth seal grooves 58*a* and 58*b*, each with a fifth seal 60*a* and 60*b*.

The landing shoulder 54 can be disposed between the third portion 22 and the fourth portion 31.

Figure 4:
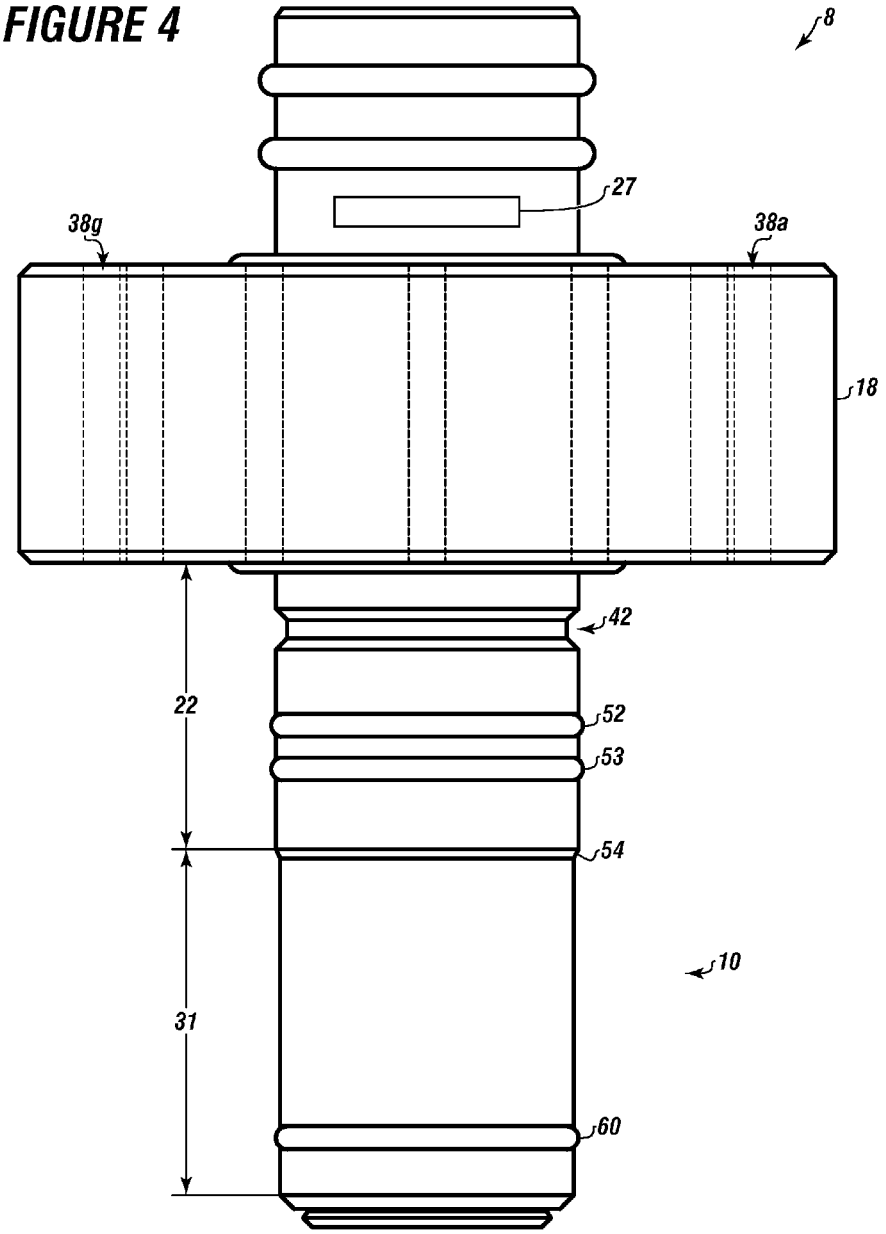
FIG. 4 depicts a perspective view of the second portion, the third portion, and the fourth portion of the one-piece central tubular.

FIG. 4 depicts a perspective view of the second portion 18, the third portion 22, and the fourth portion 31 of the one-piece central tubular 10.

A plurality of fastener holes, such as 38*a*-38*g*, can be formed in the second portion 18 and configured to receive bolts.

The third portion 22 can have the landing shoulder 54 and the locking groove 42. The third seal 52 and the fourth seal 53 can be secured thereto.

The fourth portion 31 can have the fifth seal 60 secured thereto.

In embodiments, the wellhead protection tool 8 can have a message area 27, which can allow the wellhead protection tool 8 to be marked to indicate the type of tubing head the wellhead protection tool 8 can engage with.

Figure 5:
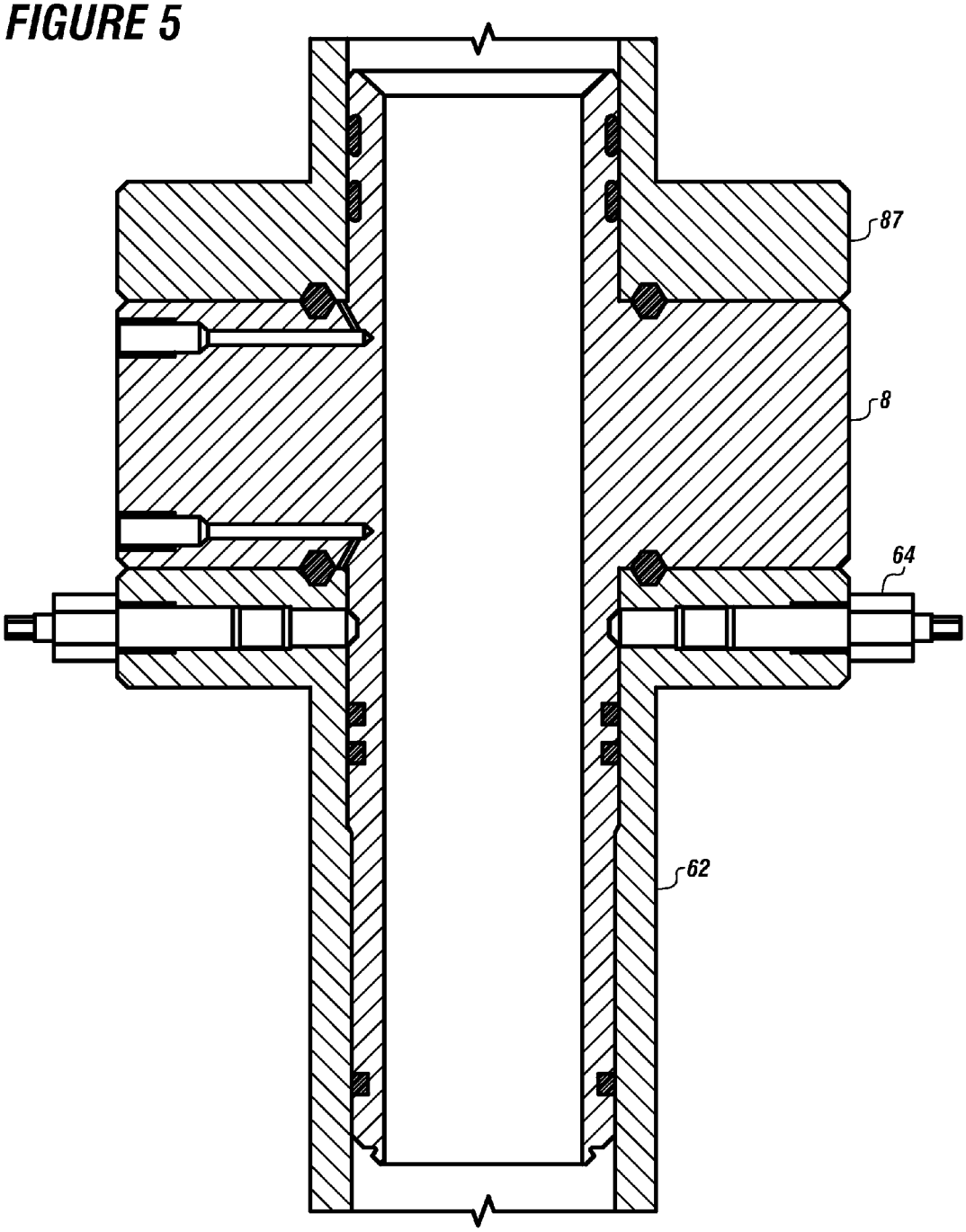
FIG. 5 is a perspective view of the wellhead protection tool inserted in a tubing head.

FIG. 5 is a perspective view of the wellhead protection tool 8 inserted in a tubing head 62.

A gate valve 87 can be disposed on the wellhead protection tool 8. The gate valve 87, tubing head 62, and the wellhead protection tool 8 can be secured to one another by mechanical fasteners. The wellhead protection tool 8 can be secured in the tubing head by locking pins 64.

Figure 6:
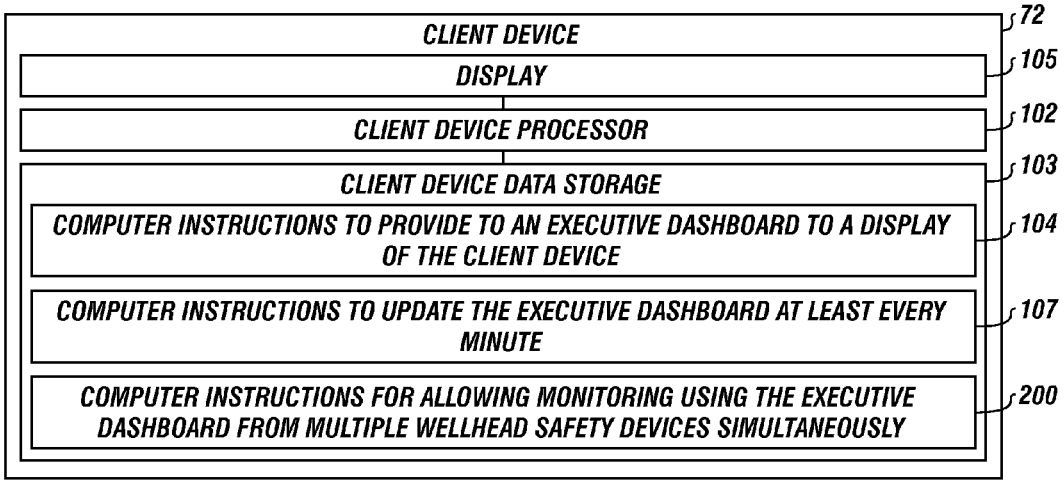
FIG. 6 depicts a schematic of the client device

FIG. 6 depicts a schematic of the client device 72.

In one or more embodiments, the client device 72 can be a laptop, a cell phone, a satellite phone, a tablet, another type of processor, a personal digital assistant, a web server, or combinations thereof.

The client device 74 can have a client device processor 102 in communication with a client device data storage 103.

The client device data storage 103 can have computer instructions to provide to an executive dashboard to a display of the client device 104.

The display 105 can present the executive dashboard.

The client device data storage 103 can have computer instructions to update the executive dashboard at least every minute 107.

The client device data storage 103 can also have computer instructions for allowing monitoring using the executive dashboard from multiple wellhead safety devices simultaneously 200.

While these embodiments have been described with emphasis on the embodiments, it should be understood that within the scope of the appended claims, the embodiments might be practiced other than as specifically described herein.

What is claimed is:

1. A wellhead protection tool for fitting within a lower portion of a tubing head using locking pins on the tubing head to connect with a locking groove on the wellhead protection tool, and simultaneously extending into a gate valve, thereby providing redundant isolation and segmented pressurized wellhead protection from particulates, wherein the wellhead protection tool comprises:

a. a one-piece central tubular having a constant diameter central bore extending from a first end of the one-piece central tubular to a second end of the one-piece central tubular, wherein the one-piece central tubular comprises:

(i) a first portion with a first outer diameter comprising:

1. a first sloping guide formed on the first portion between the first outer diameter and the constant diameter central bore; and
2. a first seal groove disposed on the first outer diameter between the first sloping guide and a second portion;

(ii) the second portion, wherein the second portion has a second outer diameter that is larger than the first outer diameter, wherein the second portion is integral with the first portion, wherein the second outer diameter is configured to prevent the one-piece wellhead protection tool from slipping into a wellbore, and wherein the second portion comprises:

1. a first face;
2. a second face;
3. a side surface disposed between the first face and the second face;
4. a plurality of fastener holes formed between the first face and the second face and spaced equidistantly around the constant diameter central bore, wherein each fastener hole in the first face is aligned with one of the fastener holes in the second face;
5. a first ring groove formed on the first face;
6. a second ring groove formed on the second face;
7. a first injection port formed in the side surface and adapted for applying pressure to the first face to test for seal integrity; and
8. a second injection port formed in the side surface in parallel with the first injection port, wherein the second injection port is adapted to apply pressure to the second face to test for seal integrity;

(iii) a third portion with a third outer diameter, wherein the third portion is integral with the second portion and extends from the second portion opposite the first portion, wherein the third outer diameter is smaller than the second outer diameter and substantially equivalent to the first outer diameter, and wherein the third portion comprises:

1. the locking groove disposed on the third outer diameter around the constant diameter center bore for receiving the locking pins of the tubing head;
2. a third seal groove disposed on the third outer diameter, wherein the locking groove is disposed between the third seal groove and the second portion; and
3. a landing shoulder formed on the third outer diameter, wherein the landing shoulder tapers towards the second end at a slope between 40 degrees and 50 degrees for preventing the wellhead protection tool from slipping into the wellbore; and (iv) a fourth portion integral with the third portion, wherein the fourth portion has a fourth outer diameter that is at least 2 percent smaller than the second outer diameter, and wherein the fourth portion comprises:

1. a second guide disposed on the second end and tapering from the fourth outer diameter towards the constant diameter central bore; and
2. a fifth seal groove disposed on the fourth outer diameter between the landing shoulder and the second guide;

b. a first seal disposed in the first seal groove for sealing against an inner diameter of the gate valve;

c. a first ring gasket disposed in the first ring groove;

d. a second ring gasket disposed in the second ring groove;

e. a third seal disposed in the third seal groove for sealing the one-piece central tubular against an inner diameter of the tubing head; and f. a fifth seal disposed in the fifth seal groove for sealing the one-piece central tubular against the inner diameter of the tubing head.

2. The wellhead protection tool of claim 1, wherein the second portion has a circumference greater than the first portion and the third portion.

3. The wellhead protection tool of claim 1, further comprising a second seal groove disposed on the first outer diameter between the first sloping guide and the second portion, wherein the second seal groove is parallel to the first seal groove.

4. The wellhead protection tool of claim 3, further comprising a second seal disposed in the second seal groove for sealing against the inner diameter of the gate valve.

5. The wellhead protection tool of claim 1, wherein the locking groove comprises:

a. a first sloping side; and b. a second sloping side opposite the first sloping side, wherein the first sloping side and the second sloping side each taper towards a center of the locking groove.

6. The wellhead protection tool of claim 1, further comprising a fourth seal groove disposed on the third outer diameter, wherein the locking groove is disposed between the fourth seal groove and the second portion.

7. The wellhead protection tool of claim 6, further comprising a fourth seal disposed in the fourth seal groove for sealing the one-piece central tubular against the inner diameter of the tubing head.

8. The wellhead protection tool of claim 1, wherein the landing shoulder extends from a side of the one-piece central tubular at a 45 degree angle.

9. The wellhead protection tool of claim 1, further comprising a trash groove formed in the second end of the one-piece central tubular for supporting a non-pressurized seal to prevent particulates and other trash from moving up an outer side of the one-piece central tubular.

10. The wellhead protection tool of claim 1, further comprising pressure detectors in fluid communication with the first injection port and the second injection port for detecting a pressure leak from the first ring gasket and the second ring gasket.

11. The wellhead protection tool of claim 10, wherein the pressure detectors are operable independently of each other.

12. The wellhead protection tool of claim 11, further comprising a client device remote from the pressure detectors and in communication with the pressure detectors, wherein the client device is configured to receive signals from the pressure detectors over a network, wherein the client device comprises:

a. a client device processor in communication with a client device data storage;

b. computer instructions in the client device data storage to provide an executive dashboard to a display of the client device, wherein the executive dashboard provides up-to-the-minute detected pressures for a plurality of seals, and wherein the plurality of seals at least comprises: the first seal, the first ring gasket, the second ring gasket, the third seal, and the fifth seal; and c. computer instructions in the client device data storage to update the executive dashboard at least every minute.

13. The wellhead protection tool of claim 12, wherein:

a. the client device is a laptop, a cell phone, a tablet, a satellite phone, another type of processor, a personal digital assistant, a web server, or combinations thereof; and b. the network is the Internet, a local area network, a wide area network, a satellite network, a cellular network, or combinations thereof.

14. The wellhead protection tool of claim 1, wherein the one-piece central tubular has a length ranging from 2 feet to 6 feet, wherein the second outer diameter ranges from 10 inches to 30 inches, and wherein the one-piece central tubular has a wall thickness that ranges from 1 inch to 3 inches.

15. The wellhead protection tool of claim 1, wherein the one-piece central tubular comprises carbon steel alloy, stainless steel, or combinations thereof.

16. The wellhead protection tool of claim 1, wherein the first seal, the first ring gasket, the second ring gasket, the third seal, and the fifth seal are each a compressible nitrile rubber seal, a polyamide seal, or an O-ring.

17. The wellhead protection tool of claim 1, wherein the locking groove is colored with a pigment to allow for easy visual recognition of a size of the wellhead protection tool in the field.

18. The wellhead protection tool of claim 1, further comprising a message area allowing the wellhead protection tool to be marked to indicate a type of tubing head that the wellhead protection tool can engage with.

* * * * *